United States Patent [19]

Berman

[11] 4,344,474

[45] Aug. 17, 1982

[54] INSULATED SHADE

[76] Inventor: Joel Berman, 1470 Hewlett Ave., Hewlett, N.Y. 11557

[21] Appl. No.: 94,694

[22] Filed: Nov. 16, 1979

[51] Int. Cl.[3] ..... A47G 5/02; A47H 1/00

[52] U.S. Cl. ..... 160/121 R; 160/238

[58] Field of Search ..... 160/121 R, 121 C, 120, 160/270, 266, 238, 25, 41, 181, 184, 107; 24/73 CH, 73 MP, 73 PM, 214

[56] References Cited

U.S. PATENT DOCUMENTS

| | | | |
|---|---|---|---|
| 249,764 | 11/1881 | Herold | 160/25 X |
| 1,309,488 | 7/1919 | Richardson | 160/266 X |
| 2,640,722 | 6/1953 | Hosking | 24/214 X |
| 2,660,659 | 11/1953 | Sarno | 160/238 X |
| 3,701,376 | 10/1972 | Froget | 160/121 |
| 3,789,904 | 2/1974 | Takazawa | 160/120 |
| 4,020,889 | 5/1977 | Karoll | 160/120 |
| 4,194,550 | 3/1980 | Hopper | 160/121 R |

*Primary Examiner*—Rodney H. Bonck
*Attorney, Agent, or Firm*—Charles E. Baxley

[57] ABSTRACT

Multiple layer thermal insulating shade fabric is attached to the surface of the shade roller in accordance with this invention through the application of a snap fastener to an undercut longitudinal slot formed in the surface of the roller. Journal plates having oblong slots formed in the surface to accommodate the ends of the bushings and weighted bars that separate the layers of shade material fabric also provide a certain degree of adjustment to accommodate minor differences in the rate and angle with which the individual layers of fabric comprising the shade are rolled on or off the shade roller.

3 Claims, 3 Drawing Figures

INSULATED SHADE

This invention relates to window shades and more particularly, to apparatus for attaching more than one layer of shade material to a shade roller, and the like.

The increasing cost of heating fuels and the need to conserve all sources of energy has made it desirable to find improved means for thermally insulating residential dwellings, commercial buildings and the like. In many residential structures, for example, the windows are perhaps the greatest source of heat loss. Storm windows, thermal pane glass and heavy drapes frequently have been used as a means to reduce the loss of heat through the windows. Multiple thicknesses of shade material on occasion also have been used not only to provide some measure of privacy and protection from the sun's glare but also to provide a certain measure of thermal insulation for the window. Shades of this latter nature often have multiple layers of fabric which provide thermally insulating air pockets between successive layers of the fabric. Further in this respect there also is a need to change from a winter insulating shade that reduces heat loss to a generally transparent summer shade that reduces heat gain. Shades of these types, however, impose substantial loads on the customary staples and the like which are used to attach the shade fabric to the shade roller.

There is a further need to provide a simple yet sturdy means for changing shades on the larger, motorized roller tubes in a manner that will avoid the usual requirement to first remove the roller tube before changing the shades in question.

Thus, there is a need to provide a simple, sturdy and inexpensive technique for attaching these heavier, multiple fabric layer thermal insulating shades to their respective shade rollers and to permit these winter and summer shades to be easily changed. To satisfy the need to suitably attach shade material to shade rollers a number of proposals have been advanced.

Illustrative of these shade and shade roller combinations, attention is invited to the following patents:

U.S. Pat. No. 1,764,789 granted June 17, 1930 to J. Held for "Window Shade" shows multiple layers of shade fabric attached to a roller. The means for attachment between the shade and the roller, however, is not specified in the Held 1,764,789 Patent.

U.S. Pat. No. 1,791,647 granted Feb. 10, 1931 to H. Stacks for "Adjustable Shade and Roller Therefor" also fails to show any specific connection between a multiple layer fabric shade and the respective roller.

U.S. Pat. No. 1,898,686 granted Feb. 21, 1933 to C. W. Rice for "Roller for Shades and the Like" shows a shade secured to a roller by trapping a beaded edge of the window shade fabric within an undercut slot that is formed in the roller surface.

U.S. Pat. No. 2,029,675 granted Feb. 4, 1936 to P. M. Schlamp for "Window Shade" shows two spaced layers of shade material. The Schlamp 2,029,675 Patent however, fails to show any specific means for connecting the two layers of shade material to the roller structure.

U.S. Pat. No. 2,189,567 granted Feb. 6, 1940 to E. J. Miller for "Awning Strip" shows a beaded awning head received within a cover member.

U.S. Pat. No. 2,280,385 granted Apr. 21, 1942 to C. Tietig for "Window Shade or the Like" shows multiple layers of shade fabric secured to a roller or rollers by means of tacks or other fastening devices.

U.S. Pat. No. 2,306,086 granted on Dec. 22, 1942 to F. S. Smith for "Thermally Insulating Window Shade Construction" also shows tacks or staples for connecting a shade to the roller.

U.S. Pat. No. 2,328,257 granted Aug. 31, 1943 to R. R. Butts for "Ventilating Blackout Roller Shade" also fails to show any specific technique for attaching a double thickness of shade material to a roller.

U.S. Pat. No. 3,186,712 granted June 1, 1965 to M. Kessler for "Coil-Up Bowling Return Gutter" shows a barb on a gutter edge that is received between the edges of an aperture which locks the barbs and gutter in position.

U.S. Pat. No. 3,701,376 granted Oct. 31, 1972 to Pierre Froget for "Device for Slide-Shifting and Winding Twin Vertical Screens or Blades" shows one of the screens in a multiple layer shade construction secured to the winding drum. The screen is clamped between a pair of strips which are secured to an inner slide. The inner slide has radial studs which extend through a slot that is formed in the wall of the winding drum.

U.S. Pat. No. 3,724,524 granted Apr. 3, 1973 to Fred S. Potter for "Picture Screen Roller Attachment" shows a fabric locking groove in the roller in which a strip that is secured in the end of the shade fabric is wedged within the locking groove.

U.S. Pat. No. 3,805,873 granted Apr. 23, 1974 to Rodger D. Bloomfield for "Lock Bar Type Edge Fastener for Flexible Covers" also shows a lock bar wedged within a groove for securing the flexible cover to a structure.

U.S. Pat. No. 3,851,848 granted Dec. 3, 1974 to Robert D. Wiele for "Awning Rail" shows a double layer of awning fabric enclosing a beading of cord channel to prevent the awning from being pulled away from the channel.

U.S. Pat. No. 3,987,835 granted Oct. 26, 1976 to Roger D. Bloomfield for "Double Cord Edge Fastener" fails to show any specific means for attaching a multiple layer insulating shade to a shade roller.

Further in this regard the technique also must be compatible with modern methods of mass assembly.

These problems of the prior art are largely overcome through the practice of the invention. Illustratively, one or more undercut recesses are formed in the surface of the roller. Resilient snap-in fasteners are riveted, stitched or otherwise fastened to an end of one or more sheets of fabric which comprise the multiple-layer thermally insulating winter shade or reflective and transparent summer shade. The fasteners, moreover are provided with resilient levers which are molded into base portions that are somewhat wider than the narrow confines of the opening that forms part of the undercut groove in the surface of the roller. Thus, by firmly pressing these snap-in members against the opening in the groove, the resilient fasteners deform temporarily while being pressed into the narrow gap. Upon entering the broader, undercut portion of the groove, the fastener springs back into its essentially relaxed shape thereby securely joining the layer of fabric to the roller. In this way, a sturdy connection is established between one or more layers of fabric and the roller in order to enable this connection to bear the weight of the entire shade. Thus shade fabric tearing or detachment is avoided through a technique that is well suited to modern production methods.

An additional feature of the invention is provided by means of a spacer apparatus which separates the individual layers of fabric in the insulating shade in order to obtain the maximum thermal resistivity that is possible with multiple fabric layer construction. In this respect, two illustrative triangular plates are positioned at the same level at opposite sides of the shade fabric. Each of these plates has a triangular apex oriented toward the shade roller. Elongated slots are formed in each of these plates. The number of slots in each of these plates is one less than the number of layers of fabric that form the shade. Other suitably shaped plates that mate together when drawn up and become interlocked also can be used.

These slots, moreover, provide journals for rods or bushings which are interposed between and separate adjacent layers of shade fabric material. The slots are elongated or oblong, the major axes being parallel to the layers of shade fabric and oriented toward the roller. The slots enable the bushings to move relative to the shade material and thereby accommodate unequal fabric tensions as the fabric approaches the roller. By staggering the height of the slots relative to the sides of the triangular piece in which they are formed, the angle of the fabric relative to the roller also is reduced. In this way, the slotted openings permit the bushings to rise and fall and maintain a height relative to the fabric layers that compensates for differences in the rates with which the fabric layers are drawn onto the roller.

These and other features of the invention will become more apparent from an examination of the following detailed description of the invention when taken in conjunction with the drawing. The scope of the invention, however, is limited only by the claims.

Figure 1:
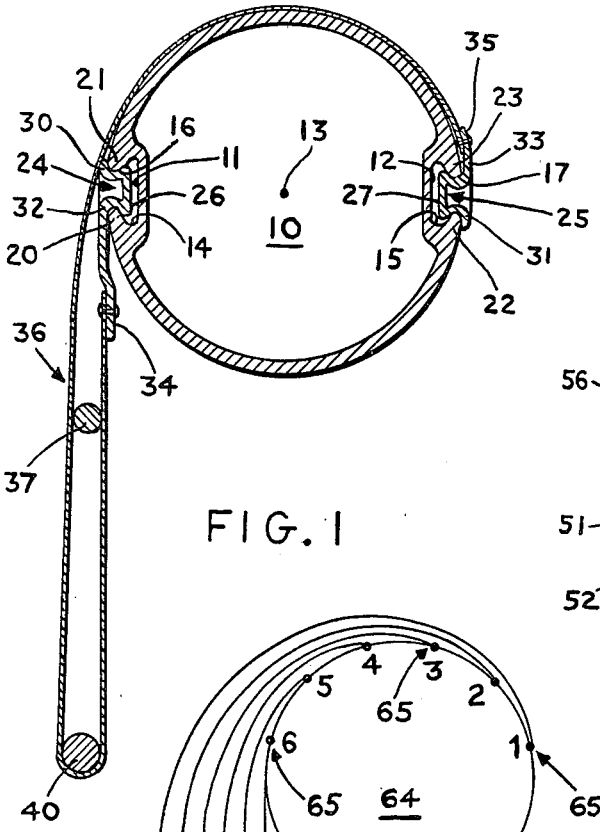
FIG. 1 is a side elevation of a typical embodiment of the invention.

For more complete appreciation of the invention attention is invited to FIG. 1 which shows a shade roller 10 which has a pair of diametrically oriented slots 11 and 12 formed in the surface of the roller 10 in directions which are parallel with the longitudinal axis 13 of the roller 10. As shown in the drawing, each of the slots 11 and 12 have respective undercut recesses 14, 15 in order to provide the base of each of the slots 11 and 12 with breadths that are greater than respective gaps 16, 17 established by spaced apart over hanging flanges 20, 21 for the slot 11, and flanges 22, 23 for the slot 12.

A pair of resilient snap fasteners 24, 25 are pressed into the slots 11 and 12 respectively. The snap fasteners, which preferably match in length the longitudinal extent of the respective slots 11 and 12, also are provided with respective broad flat bases 26, 27 that are seated within the individual slots 11 and 12. The bases 26, 27, moreover, are essentially adjacent to the surfaces of the undercut recesses 14 and 15. Each of the snap fasteners 24 and 25 is provided with a respective pair of essentially radially disposed arms 30, 31 which protrude out of the respective slots 11, 12 so that the extremities of the arms 30, 31 extend beyond the surface of the roller 10.

Further arms 32, 33 attached to the bases 26, 27 respectively, also protrude from the slots 11, 12 in a generally radially oriented direction slightly beyond the surface of the roller 10. The arms 32, 33 each terminate in an individual shade attachment member 34 and 35. In this manner one sheet of shade material 36 stitched, riveted or otherwise suitably fastened to the shade attachment member 34. The layer of the material 36 is looped over a bushing 37 and a weighted bar 40 in order to form two insulating layers of shade material. The opposite end of the shade material 36 is secured to the shade attachment means 35 on the arm 33 of the snap fastener 25.

Figure 2:
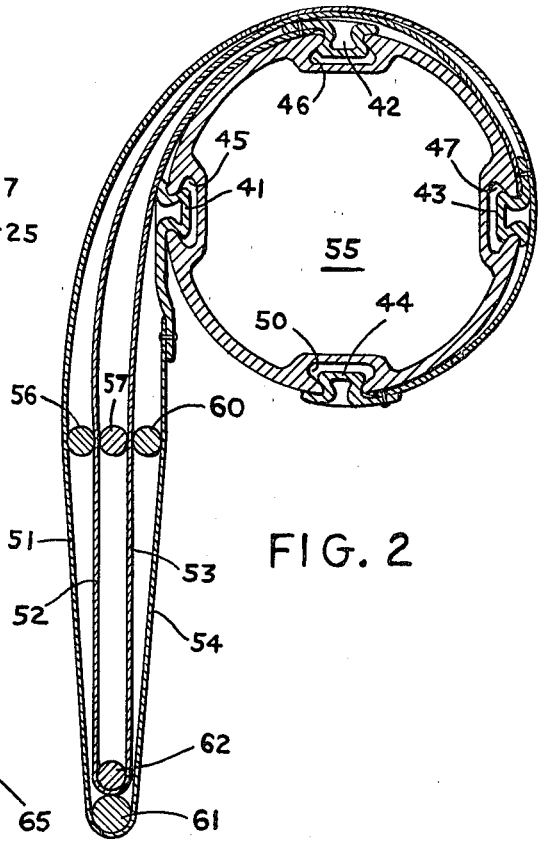
FIG. 2 is a side elevation of an embodiment of the invention which accommodates four layers of fabric.

As shown in FIG. 2 a combination of longitudinal snap fasteners 41, 42, 43 and 44, when received in respective undercut slots 45, 46, 47 and 50 support four layers 51, 52, 53 and 54 of thermally insulating shade material. As shown in FIG. 2, the individual undercut slots 45, 46, 47, 50 are formed in the longitudinal surface of a roller 55. The slots moreover are spaced at 90° intervals on the surface of the roller 55.

Because the four insulating shade layers 51, 52, 53, 54 are formed by doubling two sheets of shade material, the individual shade layers are separated from each other by means of three bushings 56, 57 and 60 which are secured between successive layers of shade material fabric near the top of the shade structure. Vertically positioned and longitudinally disposed weighted bars 61, 62 are located at the bottom in the turning folds of the two sheets of fabric that form the insulating shade layers in order to space the shade layers from each other and to weight the bottom of the shade.

Although not shown in the figures of the drawing, in order to practice the invention is is not necessary to attach each individual layer of insulating shade material to a respective shade attachment member on a snap fastener. Thus, depending on specific needs, two or more layers of insulating shade material can be attached to one shade attachment member. This of course, reduces the number of slots and snap fasteners that would be necessary to accommodate the multiple layers of insulating shade material.

Figure 3:
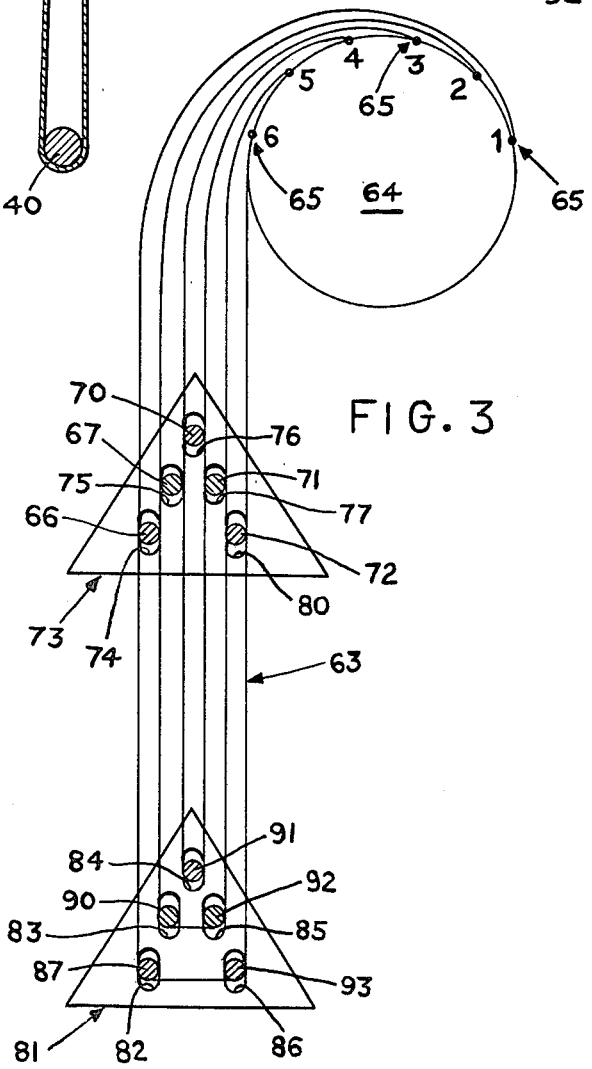
FIG. 3 is a side elevation in full section of a six layer fabric insulating shade that characterizes principles of the invention.

FIG. 3 shows a further embodiment of the invention in which a six layer thermally insulating shade 63 is secured to a shade roller 64 by means of six individual independent snap fasteners, each secured to the end of a respective layer of insulating shade material. The six snap fasteners 65 each are received in respective undercut recesses formed in the longitudinal surface of the roller 64. To accommodate all these layers of thermally insulating shade material on the roller 64 when the shade is in a "rolled-up" condition it has been found that the height of bushings 66, 67, 70, 71 and 72 should be staggered in order to reduce the angle of the respective layers of fabric relative to the surface of the roller 64, as the shade is drawn from the roller 64. Further in this respect, the ends of the bushings 66, 67, 70, 71 and 72 are received in triangular journal plates, of which only the journal plate 73 is shown in the FIG. 3 projection of the drawing. The journal plates are disposed on opposite longitudinal sides of the layers of thermal insulating shade material.

The journal plate 73 has five oblong apertures 74, 75, 76, 77 and 80 which receive and retain the associated ends of the respective bushings 66, 67, 71 and 72. In a similar manner, the journal plate that is not shown in FIG. 3 of the drawing also is provided with an equivalent set of oblong apertures which receive the opposite ends of the bushings. The oblong apertures are arranged in the respective journal plates so that their individual major axes are oriented parallel with the fabric layers in a direction toward the roller 64. In this way, the individual bushings are provided with a certain freedom of movement in a direction that is parallel with the fabric layers which allows the bushings to "float" in order to accommodate any inequalities in the manner in which the fabric is rolled up on the shade roller 64.

In a similar manner, another pair of triangular journal plates of which only the journal plate 81 is shown in the projection of the drawing that characterizes FIG. 3, accommodate oblong apertures 82, 83, 84, 85 and 86. These apertures receive the ends of respective weighted bars 87, 90, 91, 92 and 93 to enable these bars to enjoy a certain degree of free movement relative to the fabric layers in order to accommodate the 180° bend in the three fabric sheets which comprise the six layers of thermal insulating shade material.

These slotted openings or elongated apertures 82, 83, 84, 85 and 86 permit the weighted bars to rise and fall relative to the fabric layers and the roller 64 to maintain properly the height of the fabric sheets which form the layers of insulating shade material. Thus, minor variations in the rate at which the individual layers are rolled up on the roller 64 are compensated or otherwise accommodated.

In operation, attention is invited to FIG. 1 in which the two layers of shade material 36 are attached to the shade roller 10. To accomplish this, the snap fasteners 24 and 25 are pressed in diametrically opposite directions into the respective longitudinal undercut recesses 14 and 15 in the roller 10. The snap fasteners 24, 25 are secured within the respective recesses by the mutual interaction between the flanges 20, 21 (in the slot 11) and the flanges 22, 23 (in the slot 12) and the resilient arms 30, 32 on the snap fastener 24 and the resilient arms 31 and 33 on the snap fastener 25. These arms each engage the appropriate adjacent flanges, which engagement retains the snap fasteners within their individual recesses.

By drawing the weighted bar 40 vertically downward the shade material as it is drawn from the roller 10 separates into spaced layers. To roll the shade up, the weighted bar 40 is drawn down a short distance away from the roller 10 and is then released. The shade roller spring mechanism retracts the entire shade material upwardly and wraps the layers of shade material around the outer surface of the roller 10. Naturally, a chain drive or motor drive also could be used to raise and lower the shades.

Turning now to FIG. 2, it can be seen that the four layers of insulating shade material 51, 52, 53 and 54 are engaged with the shade roller 55, each in the manner described in connection with the roller 10 in FIG. 1. Thus, aside from the use of four snap fasteners to attach individually the four layers of the insulating shade material to the roller 55, the technique is essentially that which is described in connection with FIG. 1.

In FIG. 3 however, as the layers of thermal insulating material 63 are drawn onto the shade roller 64, the bushings and weighted bars shift vertically relative to the oblong slots in which these bushings and bars are journalled in order to accommodate minor differences between the rates and angles with which the individual layers which comprise the thermal insulating shade are rolled onto the shade roller 64.

The journal plates, when rolled upon the shade roller 64 sandwich the respective transverse ends of the roller. Thus, the journal plates do not interfere with the rolled shade and roller combination or press into the outer surface of the roller 64.

Consequently, multiple layers of thermally insulating shade material can be connected to the shade roller through simple installation and with materials and construction that satisfy modern manufacturing methods. The connection nevertheless is sturdy and relatively inexpensive. The installation further adjusts to individual differences in rates of fabric movement and angles between the fabrics and the roller for the individual layer or layers of fabric that are attached to the particular snap fastener.

Further in this regard by providing journal plates to receive the bushings and weighted bars, a large number of layers of thermally insulating shade material can be wound upon a shade roller in an efficient manner.

I claim:

1. A thermal insulating shade that has several layers of shade fabric comprising, a cylindrical shade roller having at least one longitudinal slot formed in the surface thereof, said slot having flanges that establish a gap therebetween, said flanges extending over a respective portion of the slot base, a snap fastener having a base and a pair of resilient generally radially protruding arms which each bear against a respective adjacent one of said flanges to retain said snap fastener within said slot, and a shade attachment member on only one of said arms and extending toward the shade fabric for fastening a layer of shade fabric thereto.

2. A shade according to claim 1 wherein said shade attachment member has more than one layer of shade fabric attached thereto.

3. A thermal insulating shade that has several layers of shade fabric comprising, a cylindrical shade roller having at least one longitudinal slot formed in the surface thereof, said slot having flanges that establish a gap therebetween, said flanges extending over a respective portion of the slot base, a snap fastener having a base and a pair of resilient generally radially protruding arms, which each bear against a respective adjacent one of said flanges to retain said snap fastener within said slot, a shade attachment member on one of said arms for fastening a layer of shade fabric thereto, a pair of journal plates spaced from each other on opposite longitudinal sides of the shade fabric, said plates each having a plurality of oblong apertures formed therein, said apertures being oriented with respective major axes generally parallel with the shade fabric, a plurality of bushings, each of said bushings being interposed between adjacent layers of the shade fabric, said bushings each having respective ends received in said oblong slots in order to adjust the fabric layers to the shade roller.

* * * * *